US011208887B2

(12) United States Patent
Johnson et al.

(10) Patent No.: US 11,208,887 B2
(45) Date of Patent: Dec. 28, 2021

(54) TOOL HOLDER INSTALLATION DEVICE AND SYSTEM

(71) Applicant: Caterpillar Paving Products Inc., Brooklyn Park, MN (US)

(72) Inventors: Nicholas B. Johnson, Dayton, MN (US); Kevin J. Magee, Buffalo, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 101 days.

(21) Appl. No.: 16/549,665

(22) Filed: Aug. 23, 2019

(65) Prior Publication Data

US 2021/0054740 A1 Feb. 25, 2021

(51) Int. Cl.

| | |
|---|---|
| ***E21C 35/19*** | (2006.01) |
| ***E02F 9/28*** | (2006.01) |
| ***B25B 27/02*** | (2006.01) |
| ***B28D 1/18*** | (2006.01) |
| ***E21C 35/18*** | (2006.01) |
| *E21C 35/197* | (2006.01) |

(52) U.S. Cl.

CPC ..... *E21C 35/191* (2020.05); *B25B 27/026* (2013.01); *B28D 1/188* (2013.01); *E02F 9/2891* (2013.01); *E21C 35/188* (2020.05); *E02F 9/2866* (2013.01); *E21C 35/197* (2013.01)

(58) Field of Classification Search

CPC ..... E21C 35/188; E21C 35/19; E21C 35/191; E21C 35/197; B28D 1/188; B25B 27/02; B25B 27/026; E02F 9/2891

USPC ..... 29/244, 252

See application file for complete search history.

(56) References Cited

U.S. PATENT DOCUMENTS

| | | | | |
|---|---|---|---|---|
| 1,899,351 | A * | 2/1933 | Overfelt | B25B 27/04 29/244 |
| 3,237,291 | A * | 3/1966 | Kelso | F16D 3/405 29/257 |
| 3,711,925 | A * | 1/1973 | Mazer | B30B 1/326 29/252 |
| 4,329,766 | A * | 5/1982 | Leonard | E02F 9/2891 29/254 |
| 5,370,448 | A | 12/1994 | Sterwerf, Jr. | |
| 6,131,261 | A * | 10/2000 | Michlin | B23P 19/02 29/251 |

(Continued)

OTHER PUBLICATIONS

Assembly Instructions for the Diamond Bit and Carbide Tool Holder Installer Tool, Nov. 5, 2016, (9 pages).

*Primary Examiner* — Janine M Kreck
*Assistant Examiner* — Michael A Goodwin
(74) *Attorney, Agent, or Firm* — Bookoff McAndrews PLLC; Jeff A. Greene

(57) ABSTRACT

A tool holder insertion device includes a frame extending from a proximal end to a distal end, the frame including first and second longitudinal arms extending between the distal end and the proximal end. The frame also includes a distal transverse arm connected to respective distal ends of the first and second longitudinal arms, a proximal transverse arm opposite the distal transverse arm, and an internal space extending from the distal transverse arm, the internal space forming an insertion opening. The tool holder insertion device also includes a drive assembly fixed to the frame, the drive assembly including a pushing surface that is movable within the internal space toward the distal end of the frame.

20 Claims, 4 Drawing Sheets

(56) References Cited

U.S. PATENT DOCUMENTS

| | | | | |
|---|---|---|---|---|
| 9,415,492 | B2 * | 8/2016 | Graber | B25B 27/304 |
| 2002/0109395 | A1 * | 8/2002 | Sollami | E21C 35/197<br>299/106 |
| 2007/0132304 | A1 * | 6/2007 | Holl | E21C 35/18<br>299/39.8 |
| 2016/0032723 | A1 * | 2/2016 | Hahn | B25B 27/064<br>29/402.08 |
| 2016/0076371 | A1 * | 3/2016 | O'Neill | E21C 35/197<br>299/10 |
| 2019/0076998 | A1 * | 3/2019 | Verkley | B25D 1/00 |

* cited by examiner

TOOL HOLDER INSTALLATION DEVICE AND SYSTEM

TECHNICAL FIELD

The present disclosure relates generally to an installation device for a tool holder, and more particularly, to an installation device for installing tool holders on a surface of a construction machine.

BACKGROUND

Milling machines or cold planers may be used to mill surfaces such as roads, to remove one or more layers of surface material prior to resurfacing. Milling machines may include a rotating cylindrical drum equipped with a series of protruding tools to remove one or more layers of material. These tools may apply a pulverizing force to separate the one or more layers of material.

A rotating drum of a milling machine may include rows of axially and circumferentially spaced tools, which may protrude from the drum as an assembly having two or more parts. A distal end of each tool assembly may include a tool bit, which may be made of a hard material such as carbide or diamond to pulverize material and facilitate separation of the surface of material. Each tool bit may be received in a respective tool holder, which may be secured within a mount that is permanently fixed, e.g., by welding, to the outer circumference of the drum. The holder and bit may be removably received in the mount to facilitate replacement of the holder and/or bit. Thus, the bit, the tool holder, or both, can be replaced when these components become worn or damaged. To facilitate secure, yet removable, assembly of the holder and bit to the mount, each tool holder may be press-fit within a receptacle of the mounts on the drum.

An exemplary wedging arrangement for a bit holder and a base of a road working machine is disclosed in U.S. Pat. No. 5,370,448 (the '448 patent) to Sterwerf, Jr. The bit holder described in the '448 patent includes a replaceable cutter bit that may be mounted to a base member for a road working machine. The bit holder includes a tapered shank while the base member has a corresponding tapered cavity. The taper of the shank and cavity allow for insertion of the bit holder by a series of physical blows along an axial direction of the bit holder.

While the bit holder described in the '448 patent may be useful in some circumstances, it may require installation by a manual process such as hammering the bit holder into place. Such a manual process may be slow and physically demanding, and may expose the installers to the risk of injury. Moreover, installation by a manual process may require the use of multiple heavy tools and require the presence of multiple operators.

The disclosed installation device may solve one or more of the problems set forth above and/or other problems in the art. The scope of the current disclosure, however, is defined by the attached claims, and not by the ability to solve any specific problem.

SUMMARY

In one aspect, a tool holder insertion device may include a frame extending from a proximal end to a distal end, the frame including first and second longitudinal arms extending between the distal end and the proximal end. The frame may also include a distal transverse arm connected to respective distal ends of the first and second longitudinal arms, a proximal transverse arm opposite the distal transverse arm, and an internal space extending from the distal transverse arm, the internal space forming an insertion opening. The tool holder insertion device may also include a drive assembly fixed to the frame, the drive assembly including a pushing surface that is movable within the internal space toward the distal end of the frame.

In another aspect, a tool holder installation assembly may include a tool holder insertion device including a frame and a drive assembly. The frame may include first and second longitudinal arms extending between a distal end of the frame toward a proximal end of the frame, a distal transverse arm connected to distal ends of the first and second longitudinal arms, and a proximal transverse arm connected to proximal ends of the first and second longitudinal arms. The frame may also include an internal space forming an insertion opening. The tool holder installation assembly may also include an adapter received within the internal space between the first and second longitudinal arms, the adapter including a pressing surface to transfer a pressing force from the drive assembly to a tool holder.

In another aspect, a tool holder installation device may include a frame extending from a proximal end to a distal end. The frame may include first and second longitudinal arms extending between the distal end and the proximal end, a proximal transverse arm connected to proximal ends of the first and second longitudinal arms, and a distal transverse arm connected to distal ends of the first and second longitudinal arms. The frame may also include an internal space defined by the first and second longitudinal arms, the proximal transverse arm, and the distal transverse arm, the internal space forming an insertion opening having an open side and a partially enclosed side, and a cross bar extending across the partially enclosed side of the internal space. The tool holder installation device may also include a drive assembly supported on the frame and extending within the internal space.

BRIEF DESCRIPTION OF THE DRAWINGS

The accompanying drawings, which are incorporated in and constitute a part of this specification, illustrate various exemplary embodiments and together with the description, serve to explain the principles of the disclosed embodiments.

DETAILED DESCRIPTION

Both the foregoing general description and the following detailed description are exemplary and explanatory only and are not restrictive of the features, as claimed. As used herein, the terms "comprises," "comprising," "having," including," or other variations thereof, are intended to cover a non-exclusive inclusion such that a process, method, article, or apparatus that comprises a list of elements does not include only those elements, but may include other elements not expressly listed or inherent to such a process, method, article, or apparatus. Moreover, in this disclosure, relative terms, such as, for example, "about," "substantially," "generally," and "approximately" are used to indicate a possible variation of ±10% in the stated value.

Figure 1:
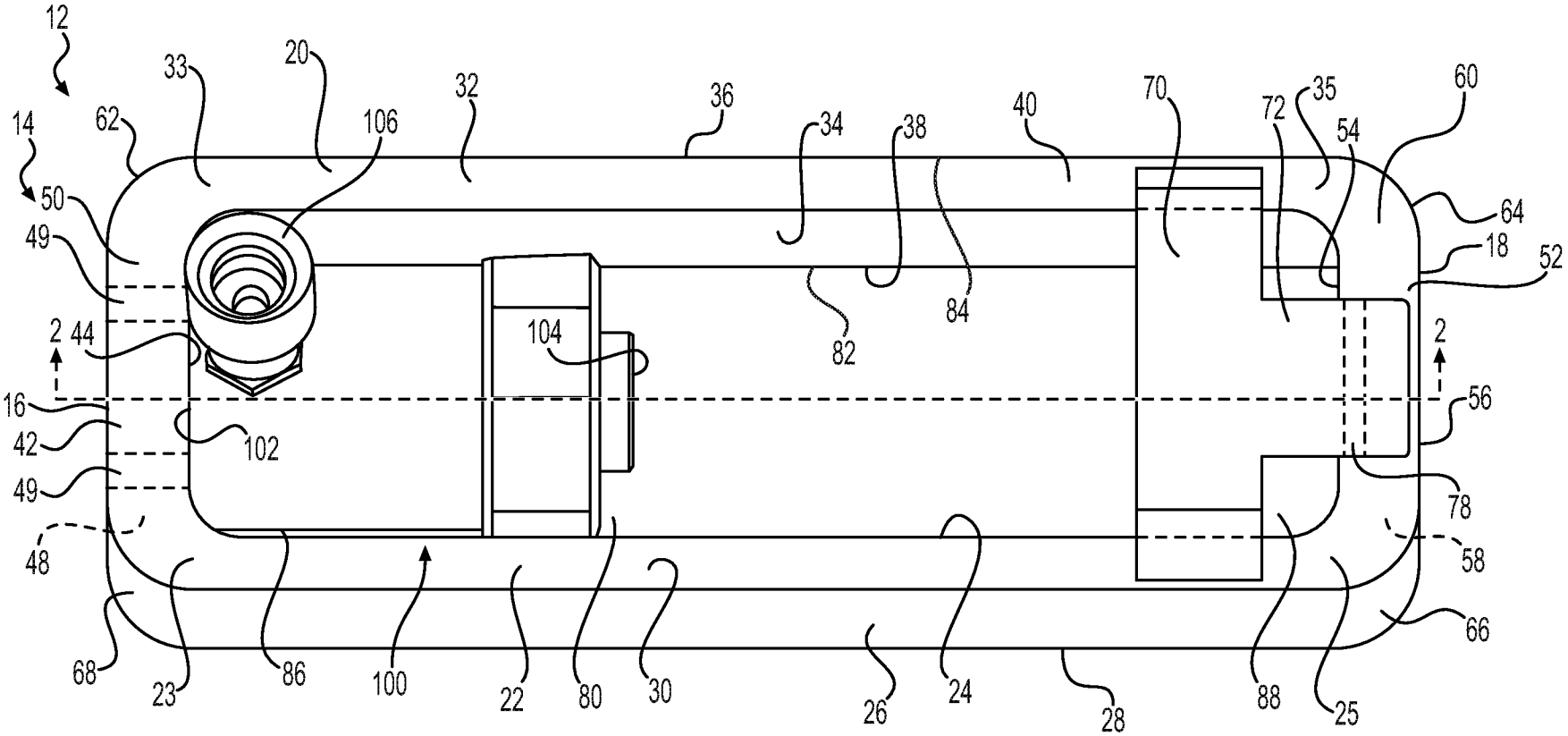
FIG. 1 is a perspective view of a tool holder installation system and an insertion device according to an aspect of the present disclosure.

FIG. 1 is a perspective view of a tool holder installation assembly or system 12, which includes a pressing or insertion device 14 for installing a tool holder 130 to a drum 160 (FIG. 3) of a milling machine or cold planer. Insertion device 14 may extend from a proximal end 16 and a distal end 18 and may include a frame 20 and a drive assembly 100 secured within frame 20. Installation system 12 may include, in addition to insertion device 14, one or more adapters 90 to facilitate installation of tool holder 130 and a cross bar 70 included on frame 20.

Frame 20 may have a generally rectangular shape that defines an internal space 80 in which drive assembly 100 is supported. In an exemplary configuration, internal space 80 may be enclosed and defined by a series of continuously joined members or arms 22, 32, 42, 52. These arms may include a pair of distally-extending arms, such as first longitudinally-extending arm 22 and second longitudinally-extending arm 32. First and second longitudinal arms 22, 32 may extend approximately parallel to each other and may form long sides of the approximately rectangular frame 20. A proximal transverse arm 42 may connect respective proximal ends 23, 33 of first and second longitudinal arms 22, 32 to form proximal end 16 of device 14. An opposite distal transverse arm 52 may form the distal end 18 of device 14. Distal arm 52 may connect respective distal ends 25, 35 of first and second longitudinal arms 22, 32. A recess 78 may be formed within an interior surface 54 of distal arm 52. Proximal arm 42 and distal arm 52 may extend along a transverse direction that is approximately orthogonal to a longitudinal direction along which arms 22 and 32 extend.

A series of curved transitions 62, 64, 66, 68 may form rounded corners of frame 20 and connect the respective arms 22, 32, 42, 52. In one aspect, arms 22, 32, 42, 52 may be formed together from a single sheet of material, such as steel. For example, arms 22, 32, 42, 52 may be provided by cutting a solid sheet of steel, such as an alloyed steel. Any suitable cutting method, such as a burnout or flame cutting process, may be employed to produce arms 22, 32, 42, and 52. By employing a cutting process, interior and outer (peripheral) rectangular surfaces of frame 20 may be provided free of any seams that may be introduced by welding. Thus, each surface of the arms 22, 32, 42, 52, as well as each surface of curved transitions 62, 64, 66, 68, may be formed without any seams.

In the exemplary configuration shown in FIG. 1, proximal arm 42 may have a thickness that is greater than a thickness of each of the first and second longitudinal arms 22, 32. Distal arm 52 may also have a thickness that is greater than a thickness of longitudinal arms 22, 32. In one aspect, proximal arm 42 may have a thickness that is greater than a corresponding thickness of distal arm 52. These thicknesses may be measured along one or both of the respective interior and peripheral surfaces of each arm. In an alternate configuration, a thickness of proximal and distal arms 42, 52 may be approximately equal, and may be larger than the thicknesses of arms 22, 32.

Figure 3:
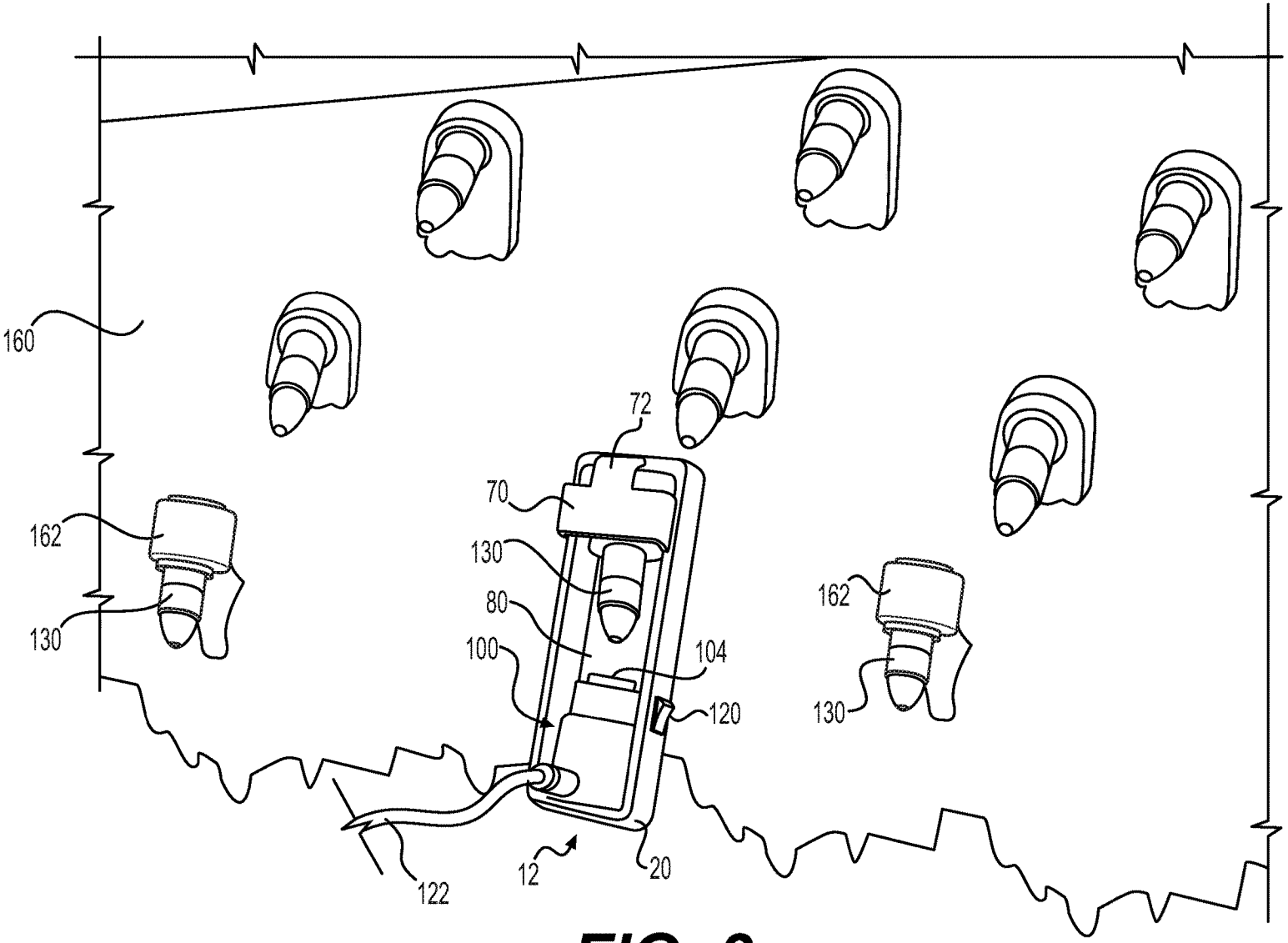
FIG. 3 is a perspective view of the tool holder installation system and insertion device of FIGS. 1 and 2 during use.

First and second longitudinal arms 22, 32 may include gripping surfaces at locations adjacent to each side of drive assembly 100. For example, an edge or transition between operator-facing surface 30 and peripheral surface 26 may be rounded or provided with an ergonomic shape to provide a gripping surface. Similar rounding and/or ergonomic shapes may form gripping surfaces at the transitions (edges) between peripheral surface 26 and drum-facing surface 28, between operator-facing surface 40 and peripheral surfaces 36 of arm 32, and/or between peripheral surface 36 and drum facing surface 38. These or other portions of longitudinal arms 22 and 32 may include a coating configured to protect against wear or oxidation of frame 20, and/or to facilitate handling of tool holder insertion device 14. For example, an ergonomic rubber or polymeric coating or covering may be provided on longitudinal arms 22 and 32, or any other portion of frame 20. Additionally or alternatively, one or more handles may be provided adjacent to drive assembly 100. For example, handles may protrude outward from the peripheral surfaces 26 and 36 of arms 22 and 32, respectively. Additionally, frame 20 may be provided with one or more switches 120 adjacent to these handles or gripping surfaces, to facilitate control of drive assembly 100, as shown in FIG. 3.

Figure 2:
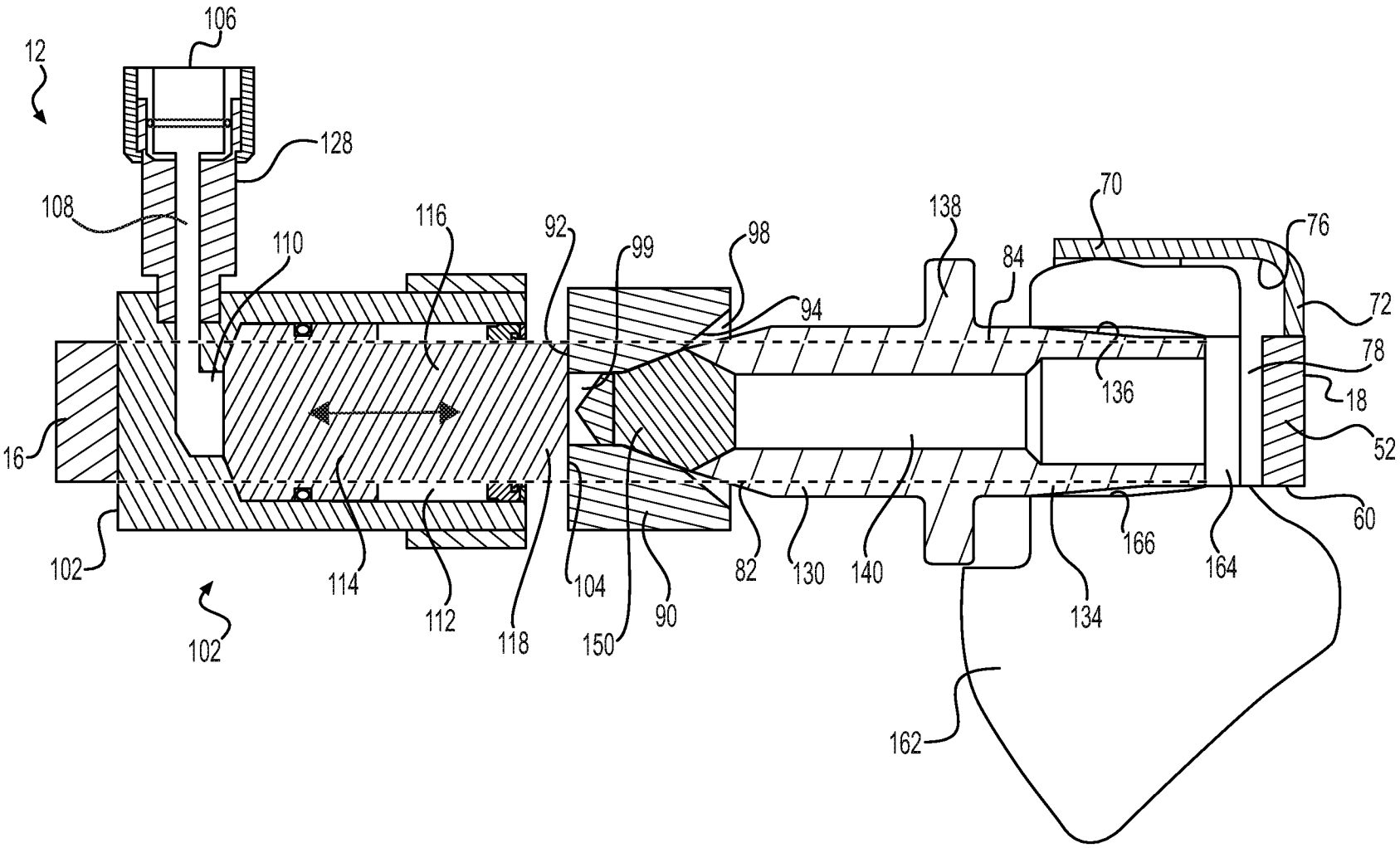
FIG. 2 is a cross-sectional view of the tool holder installation system and insertion device along line 2-2 of FIG. 1.

Internal space 80 may be defined by the interior surfaces 24, 34, 44, 54 of arms 22, 32, 42, 52. Internal space 80 may have a rectangular shape, and may include a bottom end and a top end. The bottom end of internal space 80 may form an insertion opening 82 aligned with the bottom of insertion device 14. The top end of internal space may form a partially-enclosed opening 84 (best illustrated in FIGS. 2 and 4). Interior surface 24 of first longitudinal arm 22 may define a proximal end 86 of internal space 80 that receives drive assembly 100. Interior surface 54 of distal arm 52 may define a distal end 88 of internal space 80 which is enlarged by recess 78. This distal end 88 may be sized so as to slide over a portion of a drum block 162 (FIG. 2). Each of the arms 22, 32, 42, 52 may also include respective peripheral (exterior) surfaces 26, 36, 46, 56. The top surface of frame 20 may include operator-facing surfaces 30, 40, 50, 60. This top surface may face an operator during the use of installation system 12 (see FIG. 3).

Figure 4:
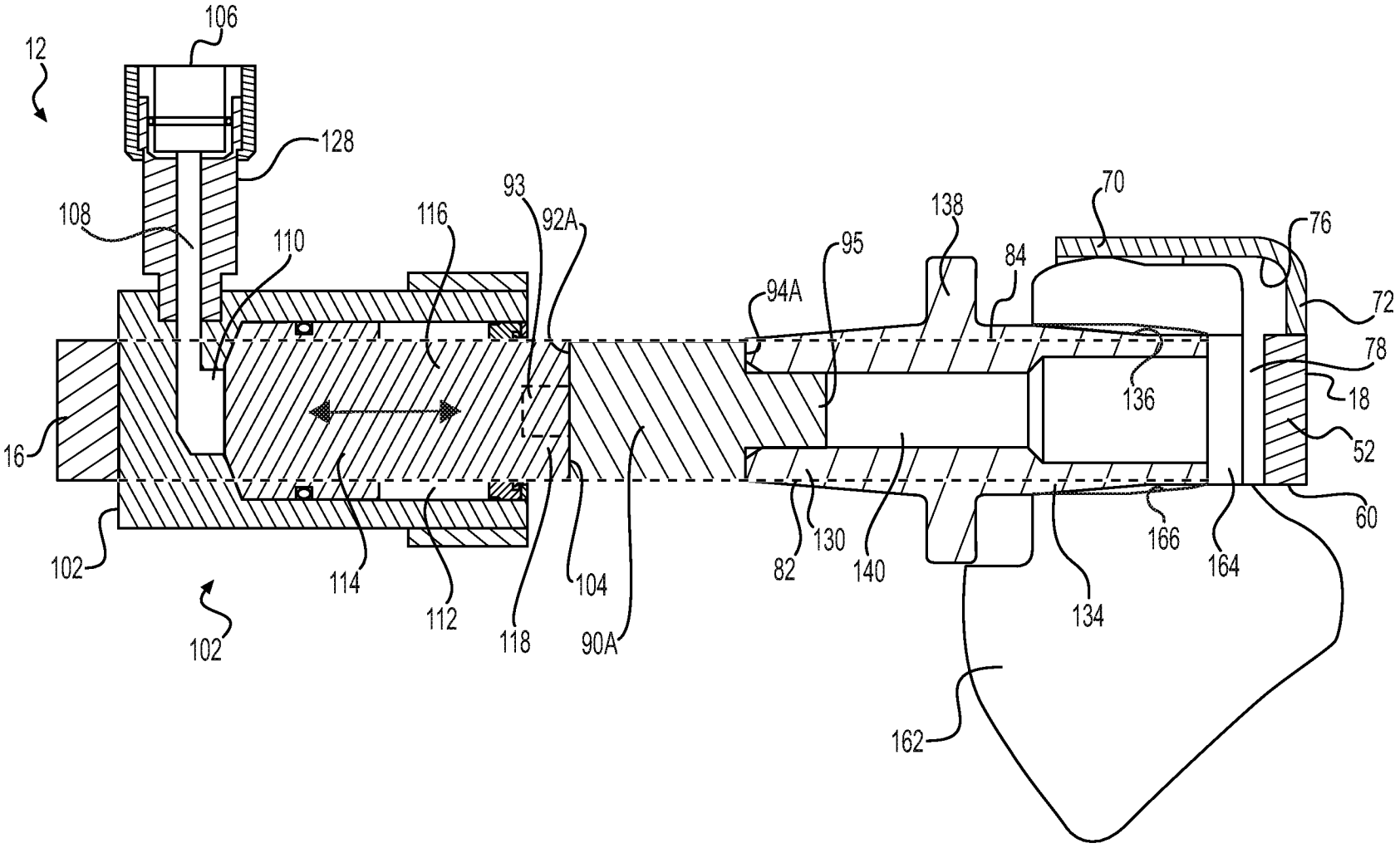
FIG. 4 is a cross-sectional view of the tool holder installation system and insertion device of FIGS. 1-3 with an alternate adapter.

Drive assembly 100 forms a pushing device and may be provided opposite distal arm 52 and cross bar 70. Drive assembly 100 may include any suitable device for generating and applying a pushing force in a direction toward distal end 18. In one aspect, drive assembly 100 may include a hydraulic cylinder or other fluidly-driven pushing mechanism, such as a pneumatic system. Drive assembly 100 may include a hydraulic fluid connector 106 configured to connect to a source of pressurized hydraulic fluid via a hose 122 (FIG. 4).

Drive assembly 100 may be fixed to proximal arm 42 at a surface 102 of drive assembly 100. Any suitable fastening mechanism may be employed to secure drive assembly 100 to frame 20. In one aspect, proximal arm 42 may include one or more fastening holes 49 for receiving one or more respective fasteners such as bolts. These fasteners may extend within respective threaded holes (not shown) of drive assembly 100. Alternatively, drive assembly 100 may be secured to frame 20 by one or more brackets or by welding.

Installation system 12 may include one or more adapters 90 (FIG. 2) that may be received by and supported on drive assembly 100 and/or tool holder 130. An exemplary adapter 90, as shown in FIG. 2, may have a generally cylindrical body shaped so as to be received on a proximal end of tool holder 130. A proximal end of adapter 90 may form a pushed surface 92, which may have an annular shape configured to receive pushing surface 104 of a piston 114 of drive assembly 100.

FIG. 2 is a sectional view along line 2-2 of FIG. 1, showing an installation system 12 positioned against tool holder 130 prior to installation of tool holder 130 within drum block 162. When in this position, pushing surface 104 may be in contact with pushed surface 92 of adapter 90. The bottom end of internal space 80 that forms an open side or insertion opening 82, may receive drum block 162 at a position opposite to drive assembly 100. Insertion opening 82 may be provided within a plane that includes the bottom or drum-facing surfaces 28, 38, 48, and 58. Enclosed opening 84 may be extend approximately parallel to insertion opening 82. Enclosed opening 84 may be enclosed or covered by cross bar 70 that extends across first and second longitudinal arms 22, 32 so as to close at least a distal portion of internal space 80. In one aspect, cross bar 70 may be connected to the distal ends 25, 35 of arms 22, 32 and may enclose at least a portion of the distal end of enclosed opening 84. Cross bar 70 may include a distally-extending member 72 that connects cross bar 70 to distal arm 52. An enclosing surface 76 may be defined by surfaces of cross bar 70 and distal member 72 that face internal space 80. Enclosing surface 76 may at least partially enclose opening 84 of internal space 80. As can be seen in FIG. 2, openings 82 and 84 may correspond to a width of frame 20. By providing a frame 20 with a smaller width, drive assembly 100 may protrude through one or both openings 82 and 84, as shown in FIG. 2.

Drive assembly 100 may be a hydraulic cylinder that includes a hydraulic fluid inlet passage 108. Hydraulic fluid inlet passage 108 may extend from an opening of hydraulic fluid connector 106 to a hydraulic fluid reservoir 110 provided upstream of an internal volume 112 in which a piston 114 may be provided. Piston 114 may be slidable within internal volume 112 away from hydraulic fluid reservoir 110 and may include a central shaft portion 116 connected to a distal pusher portion 118. A distal end of pusher portion 118 may include pushing surface 104. Pushing surface 104 may be any suitable material. For example, pushing surface 104 may be formed by a polymeric, rubber, metallic, or other material configured to apply a pushing force to a pushed surface 92 without causing damage to the pushed surface and without becoming deformed or damaged. While pushing surface 104 and pusher portion 118 are illustrated as being an integral portion of piston 114, a removable pusher portion 118 and pushing surface 104 may be provided, e.g., via a threaded connector.

Adapter 90 may be mountable on at least one of drive assembly 100, a tool bit 150 connected to tool holder 130, or a proximal end of tool holder 130 itself. Different adapters 90 included in installation system 12 may be interchanged with the exemplary adapter 90 shown in FIG. 2. As illustrated in FIG. 2, one exemplary adapter 90 may be adapted to receive an end of tool holder 130 on which a tool bit 150 is inserted. The insertion of tool holder 130 and/or tool bit 150 may be facilitated by an opening as a tapered through-hole extending through annular surfaces on each end of adapter 90. This opening may include a cylindrical portion 99 extending inwardly from the end of adapter 90 that includes pushed surface 92. This cylindrical portion 99 may transition to a tapered portion 98 including one or more tapered surfaces. These tapered surfaces may include a pressing surface 94 configured to come into pressing contact with tool bit 150 and/or tool holder 130. The pressing surface 94 may be shaped to distribute a pressing force across tool bit 150, for example, without causing damage to tool bit 150 or tool holder 130. In some configurations, tapered portion 98 may include internal surfaces having varying degrees of taper, as shown in FIG. 2. Alternatively, an entirety of tapered portion 98 may be formed with a single taper, if desired.

Tool holder 130 may include an internal opening 140 configured to receive tool bit 150 or an appropriately-shaped adapter (e.g., adapter 90A, FIG. 4). Tool holder 130 may include a flange 138 which may include one or more surfaces, such as flats or recesses, configured to facilitate removal of tool holder 130 once tool bit 150 becomes worn or damaged. A projection or shaft portion 134 may extend from flange 138. Shaft portion 134 may have an outer circumference that includes a tapered surface 136 to facilitate a press-fit relationship when tool holder 130 is inserted within a corresponding tapered surface 166 of a tool holder receptacle 164 of drum block 162.

FIG. 3 is a perspective view illustrating installation system 12 positioned with a tool holder 130. Adapters 90, 90A are not shown in FIG. 3 for clarity. Cylindrical drum 160, which may be part of a cold planer, may include a series of drum blocks 162 arranged in one or more rows. Drum blocks 162 may be distributed in any regular or irregular pattern, and may extend at different angles with respect to drum 160. Each drum block 162 may be permanently attached to a drum 160 by welding, for example.

Each drum block 162 may include a tool holder receptacle 164, as illustrated in FIGS. 2 and 4, for securing tool holder 130 via press-fit. The frame 20 of insertion device 14 may be shaped so as to receive drum block 162 at a distal portion thereof. When insertion device 14 is positioned as shown in FIG. 3, drum block 162 may be extend within internal space 80 and through both insertion opening 82 and enclosed opening 84. The cross bar 70 and distal member 72 may be configured to contact drum block 162 when so positioned within internal space 80. Thus, cross bar 70 and distal member 72 may facilitate alignment of insertion device 14 on drum block 162.

Hydraulic hose 122 may be connected to insertion device 14 by fluid connector 106. Hose 122 may be connected to any suitable controllable source of hydraulic fluid, such as a pneumatically-powered pump that applies pressure to hydraulic fluid upstream of drive assembly 100. In one aspect, an exemplary pneumatically-powered pump may be controlled by a switch, such as a switch 120 or a foot pedal. Switch 120 may control a pressing force applied by drive assembly 100 via piston 114 and pushing surface 104. In one aspect, the hydraulic cylinder of drive assembly 100 may include a double-acting hydraulic cylinder, in which one or more ports (not shown) may be provided to facilitate retraction of piston 114 and pushing surface 104. In such a configuration, control switch 120 may be a three-way switch, such as a rocker switch, movable between an advancing position, a reversing position, and an off position. Alternatively, drive assembly 100 may instead include a single-acting (manually-retracted) hydraulic cylinder.

FIG. 4 is a cross-sectional view of another adapter 90A that may be included as a component of installation system 12. Installation system 12 may include a plurality of adapters such as adapters 90 and 90A, which may be part of the assembly formed by installation system 12. As shown in FIG. 4, adapter 90A may be connected to a tool holder 130 without a tool bit 150. The tool holder 130 inserted via adapter 90A may be identical to a tool holder 130 inserted by adapter 90, or may have a different shape. Adapter 90A may include a proximal pushed surface 92A and a distal protrusion 95. A pressing surface 94A for contacting a surface of tool holder 130 may be provided between the proximal and distal ends of adapter 90A. The size of the protrusion 95 may be based on the corresponding size of the opening 140 of tool holder 130, for example.

If desired, a protrusion 93 may be provided at a proximal end of adapter 90A so as to extend from pushed surface 92A instead of, or in addition to, protrusion 95. Proximal protrusion 93 may be provided with a size and shape that corresponds to a recess formed in pusher portion 118, which, as described above, may be provided as a removable portion of piston 114. Thus, adapter 90A may include a protrusion that is receivable within tool holder 130, within pushing surface 104 of pusher portion 118, or both.

INDUSTRIAL APPLICABILITY

Installation system 12 and tool holder pressing or insertion device 14 may be used in conjunction with any appropriate milling machine, such as a cold planer, that accepts a tool holder and/or tool bit via an interference or press-fit relationship. For example, by including a plurality of adapters with different sizes and/or shapes, installation system 12 may be useful for installation of various tool holders 130 and/or tool bits 150.

A new or replacement tool holder 130 may be placed by hand within a drum block 162 on the surface of drum 160 in preparation for installation. An appropriate adapter, such as adapter 90 (FIG. 2) or adapter 90A (FIG. 4), may be placed on tool holder 130 or bit 150, and/or within pushing surface 104 of piston 114. For example, adapter 90 may include an opening with a tapered interior portion 98 that may be secured on tool bit 150 by friction. Alternatively, an operator may hold adapter 90 on tool bit 150 with one hand, during the process of positioning insertion device 14 with another hand. The selected adapter 90 may have a length that corresponds to the stroke of driving assembly 100.

As shown in FIG. 3, in order to apply insertion device 14 to a tool holder 130 and drum block 162, frame 20 may be positioned so that surfaces 28, 38, 48, and 58 face drum 160. Once in this position, the rectangular frame 20 may surround one of the tool holders 130. Insertion device 14 may contact drum block 162 such that a portion of drum block 162 extends through insertion opening 82 and enclosed opening 84. Cross bar 70 may provide a physical limit or stop to the movement of insertion device 14 with respect to drum block 162, as shown in FIGS. 2 and 4, for example, and may facilitate placement of frame 20 on drum block 162.

Pushing surface 104, adapter 90 or 90A, tool holder 130, and drum block 162 (and tool holder receptacle 164 within block 162) may be brought into alignment when insertion device 14 is placed on drum block 162. While in this position, driving power may be provided to drive assembly 100 by supplying hydraulic fluid via hose 122, in response to actuation of switch 120, for example. This hydraulic fluid may advance piston 114, thereby causing pushing surface 104 to extend and apply a pressing force to adapter 90 or 90A, which is transferred, via pressing surface 94 or 94A, to tool holder 130. This force may be sufficient to advance tool holder 130 within tool holder receptacle 164, where tool holder 130 may be retained by a press-fit between tapered surface 136 of projection 134 and tapered surface 166 of tool holder receptacle 164. In one aspect, recess 78 may provide space to allow an end of projection 134 to extend through, and project from, an end of drum block 162 that faces distal arm 52. Recess 78 may provide space for this projection of tool holder 130.

The installation system 12 and tool holder insertion device 14 described herein may provide improved handling and versatility. For example, by providing a seam-free frame 20, stresses may be evenly distributed and the risk of cracks or fracturing may be reduced. Weak points, which may be introduced by welding areas of high stress, may be avoided. A weight of installation system 12 may be reduced, such that the installation of a tool holder 130 (and tool bit 150) may be performed by a single operator. Thus, manpower requirements and installation time may be reduced. Additionally, by providing a proximal arm 42 that is thicker than longitudinal arms 22, 32, the arm on which drive assembly 100 is mounted may have sufficient strength to withstand stresses which may occur during operation of drive assembly 100, without significantly increasing the weight of the frame 20. By reducing a width of frame 20 and allowing drive assembly 100 to protrude through one or both openings 82, 84, a weight of device 14 may be reduced. Additionally, cross bar 70 and distal member 72 may provide a mechanism to distribute stress-loading, as well as to facilitate proper placement/coupling of insertion device 14 on drum block 162 to properly distribute forces and maintain the coupling.

By providing one or more adapters 90, 90A, it may be possible to uniformly apply a pushing force to a tool holder 130 for reliable insertion of the tool holder 130 within a drum block 162. Additionally, a size (e.g., length) of an adapter 90, 90A, may take into account a maximum stroke length of drive assembly 100. Thus, the installation system 12 may be applicable to tool holders 130 having different lengths.

It will be apparent to those skilled in the art that various modifications and variations can be made to the disclosed apparatus and system without departing from the scope of the disclosure. Other embodiments of the apparatus and system will be apparent to those skilled in the art from consideration of the specification and practice of the apparatus and system disclosed herein. It is intended that the specification and examples be considered as exemplary only, with a true scope of the disclosure being indicated by the following claims and their equivalents.

What is claimed is:

1. A tool holder insertion device, comprising:

a frame extending from a proximal end to a distal end, the frame including:

first and second longitudinal arms extending between the distal end and the proximal end;

a distal transverse arm connected to respective distal ends of the first and second longitudinal arms;

a proximal transverse arm opposite the distal transverse arm; and an internal space extending from the distal transverse arm, the internal space forming an insertion opening;

a drive assembly fixed to the frame, the drive assembly including a pushing surface that is movable within the internal space toward the distal end of the frame; and a cross bar that extends across the first and second longitudinal arms.

2. The device of claim 1, wherein the internal space is approximately rectangular and the drive assembly is provided at a proximal end of the internal space.

3. The device of claim 1, wherein the drive assembly extends through the insertion opening.

4. The device of claim 1, wherein the first and second longitudinal arms, the proximal transverse arm, and the distal transverse arm define and enclose the internal space.

5. The device of claim 4, wherein the drive assembly is fixed to the proximal transverse arm.

6. The device of claim 4, wherein the first and second longitudinal arms, the proximal transverse arm, and the distal transverse arm form a rectangular shape having a surface that is free of seams.

7. The device of claim 4, wherein the proximal transverse arm has a thickness that is greater than a thickness of the first longitudinal arm.

8. The device of claim 1, wherein the distal transverse arm includes a recess that forms an enlarged distal end of the internal space.

9. The device of claim 1, wherein the cross bar at least partially covers a distal portion of the internal space opposite the drive assembly.

10. The device of claim 9, wherein the cross bar is shaped to abut a block protruding from a drum of a milling machine.

11. A tool holder installation assembly, comprising:

a tool holder insertion device including a frame and a drive assembly, the frame including:

first and second longitudinal arms extending between a distal end of the frame and a proximal end of the frame;

a distal transverse arm connected to distal ends of the first and second longitudinal arms;

a cross bar connected to the first and second longitudinal arms;

a proximal transverse arm connected to proximal ends of the first and second longitudinal arms; and an internal space forming an insertion opening;

a first removable adapter configured to be received within the internal space between the first and second longitudinal arms, the first adapter including a pressing surface shaped to contact a tool holder to be secured to a drum to transfer a pressing force from the drive assembly to the tool holder; and a second removable adapter configured to be received within the internal space between the first and second longitudinal arms, the second adapter including a pressing surface shaped to contact a tool bit for the tool holder to transfer a pressing force from the drive assembly to the tool bit.

12. The tool holder assembly of claim 11, wherein the second adapter includes an open end configured to receive the tool bit and the pressing surface of the second adapter is provided within the open end.

13. The tool holder assembly of claim 12, wherein the pressing surface of the second adapter is formed by a tapered surface.

14. The tool holder assembly of claim 11, wherein the drive assembly is fixed to the proximal transverse arm.

15. The tool holder assembly of claim 14, wherein the first adapter includes a protrusion shaped to be received within the tool holder or within a recess formed in the drive assembly.

16. The tool holder assembly of claim 11, wherein the second adapter includes a pressed surface on an exterior of the second adapter, and wherein the pressing surface is formed on an interior of the second adapter.

17. A tool holder installation device, comprising:

a frame extending from a proximal end to a distal end, the frame including:

first and second longitudinal arms extending between the distal end and the proximal end;

a proximal transverse arm connected to proximal ends of the first and second longitudinal arms;

a distal transverse arm connected to distal ends of the first and second longitudinal arms;

an internal space defined by the first and second longitudinal arms, the proximal transverse arm, and the distal transverse arm, the internal space forming an insertion opening having an open side and a partially enclosed side; and a cross bar extending across the partially enclosed side of the internal space so as to cover the internal space when viewed from a direction orthogonal to a longitudinal direction defined by the first and second longitudinal arms; and a drive assembly supported on the frame and extending within the internal space.

18. The tool holder installation device of claim 17, wherein the cross bar includes a distal arm that connects the cross bar to the distal transverse arm.

19. The tool holder installation device of claim 17, wherein the drive assembly includes a hydraulically-driven piston within the internal space to apply a pressing force toward the distal transverse arm.

20. The tool holder installation device of claim 17, further including a removable adapter configured to be received within the internal space between the first and second longitudinal arms, the adapter being shaped to contact a tool holder to be secured to a drum, the adapter including a first protrusion shaped to be received within a recess formed in the drive assembly and a second protrusion shaped to be received in an opening of the tool holder.

* * * * *